US008617288B2

(12) United States Patent
Fujitsuka et al.

(10) Patent No.: US 8,617,288 B2
(45) Date of Patent: Dec. 31, 2013

(54) SINTERED MATERIAL FOR VALVE GUIDES AND PRODUCTION METHOD THEREFOR

(75) Inventors: Hiroki Fujitsuka, Matsudo (JP); Hideaki Kawata, Matsudo (JP)

(73) Assignee: Hitachi Powdered Metals Co., Ltd., Chiba (JP)

( * ) Notice: Subject to any disclaimer, the term of this patent is extended or adjusted under 35 U.S.C. 154(b) by 89 days.

(21) Appl. No.: 13/242,559

(22) Filed: Sep. 23, 2011

(65) Prior Publication Data

US 2012/0082584 A1 Apr. 5, 2012

(30) Foreign Application Priority Data

Sep. 30, 2010 (JP) ..... 2010-223009

(51) Int. Cl.
*C22C 33/02* (2006.01)
*B22F 3/12* (2006.01)

(52) U.S. Cl.
USPC ..... 75/243; 75/231; 75/237; 75/246; 419/11; 419/25

(58) Field of Classification Search
USPC ..... 75/243, 246, 231; 419/11, 25
See application file for complete search history.

(56) References Cited

U.S. PATENT DOCUMENTS

| | | | |
|---|---|---|---|
| 5,259,860 | A | 11/1993 | Ikenoue et al. |
| 5,507,257 | A | 4/1996 | Sakai et al. |
| 2002/0023518 | A1 | 2/2002 | Chikahata et al. |
| 2006/0032328 | A1 | 2/2006 | Chikahata et al. |

FOREIGN PATENT DOCUMENTS

| | | |
|---|---|---|
| EP | 0 621 347 A1 | 10/1994 |
| JP | B2-55-34858 | 9/1980 |
| JP | A-6-41699 | 2/1994 |
| JP | A-6-306554 | 11/1994 |
| JP | B2-2680927 | 11/1997 |
| JP | A-2006-52468 | 2/2006 |
| JP | B2-4323069 | 9/2009 |
| JP | B2-4323467 | 9/2009 |

OTHER PUBLICATIONS

Jun. 8, 2012 Extended European Search Report issued in European Patent Application No. 11007960.5.

*Primary Examiner* — Roy King
*Assistant Examiner* — Ngoclan T Mai
(74) *Attorney, Agent, or Firm* — Oliff & Berridge, PLC

(57) ABSTRACT

A sintered material for valve guides consists of, by mass %, 0.01 to 0.3% of P, 1.3 to 3% of C, 1 to 4% of Cu, and the balance of Fe and inevitable impurities. The sintered material exhibits a metallic structure made of pores and a matrix. The matrix is a mixed structure of a pearlite phase, a ferrite phase, an iron-phosphorus-carbon compound phase, and a copper phase, and a part of the pores including graphite that is dispersed therein. The iron-phosphorus-carbon compound phase is dispersed at 3 to 25% by area ratio, and the copper phase is dispersed at 0.5 to 3.5% by area ratio, with respect to a cross section of the metallic structure, respectively.

11 Claims, 3 Drawing Sheets

SINTERED MATERIAL FOR VALVE GUIDES AND PRODUCTION METHOD THEREFOR

BACKGROUND OF THE INVENTION

1. Technical Field

The present invention relates to a sintered material for valve guides that may be used in an internal combustion engine, and also relates to a production method for the sintered material for valve guides. Specifically, the present invention relates to a technique for further improving wear resistance of the sintered material for valve guides.

2. Background Art

A valve guide used in an internal combustion engine is a tubular component having an inner circumferential surface for guiding valve stems of an intake valve and an exhaust valve. The intake valve may be driven so as to take fuel mixed gas into a combustion chamber of the internal combustion engine, and the exhaust valve may be driven so as to exhaust combustion gas from the combustion chamber. For guiding the valve stems of the intake valve and the exhaust valve, the valve guide is required to have wear resistance and is also required to maintain smooth sliding conditions so as not to cause wear of the valve stems for long periods. Valve guides made of a cast iron are generally used, but valve guides made of a sintered alloy have recently come into wide use. This is because sintered alloys can have a specific metallic structure, which cannot be obtained from ingot materials, and therefore the sintered alloys can have wear resistance. Moreover, once a die assembly has been made, products having the same shape can be mass-produced, and therefore the sintered alloys are suitable for commercial production. Furthermore, a sintered alloy can be formed into a shape similar to that of a product, and thereby material yield can be high in machining. Valve guides made of a sintered alloy are disclosed in, for example, Japanese Examined Patent Publication No. 55-034858 and Japanese Patents Nos. 2680927, 4323069, and 4323467.

The sintered material for valve guides disclosed in Japanese Examined Patent Publication No. 55-034858 is made of an iron-based sintered alloy consisting of, by weight, 1.5 to 4% of C, 1 to 5% of Cu, 0.1 to 2% of Sn, not less than 0.1% and less than 0.3% of P, and the balance of Fe. A photograph and a schematic view of a metallic structure of this sintered material are shown in FIGS. 3A and 3B, respectively. As shown in FIGS. 3A and 3B, in this sintered material, an iron-phosphorus-carbon compound phase is precipitated in a pearlite matrix which is strengthened by adding copper and tin. The iron-phosphorus-carbon compound absorbs C from the surrounding matrix and grows into a plate shape, whereby a ferrite phase is dispersed at a portion surrounding the iron-phosphorus-carbon compound phase. Moreover, a copper alloy phase is dispersed in the matrix. The copper alloy phase is formed such that Cu is solved in the matrix during sintering at high temperature in an amount greater than the solid solubility limit at room temperature and is precipitated in the matrix by cooling. In the photograph of the metallic structure shown in FIG. 3A, since a graphite phase was exfoliated when the sample was polished so as to observe the metallic structure, the graphite phase cannot be observed. Nevertheless, as shown in the schematic view of FIG. 3B, graphite remains inside a large pore and is dispersed as a graphite phase. This sintered material has superior wear resistance due to the iron-phosphorus-carbon compound phase. Therefore, this sintered material has been mounted in automobiles and has been commercially used by domestic and international automobile manufacturers. In this case, this sintered material is used as a common material for valve guides for internal combustion engines in four-wheeled automobiles.

The sintered material for valve guides disclosed in Japanese Patent No. 2680927 is an improved material of the sintered material disclosed in Japanese Examined Patent Publication No. 55-034858. In this material, in order to improve machinability, magnesium metasilicate minerals and magnesium orthosilicate minerals are dispersed as intergranular inclusions in the metallic matrix of the sintered material disclosed in Japanese Examined Patent Publication No. 55-034858. As with the sintered material disclosed in Japanese Examined Patent Publication No. 55-034858, this sintered material has been mounted in automobiles and has been commercially used by domestic and international automobile manufacturers.

The sintered materials for valve guides disclosed in Japanese Patents Nos. 4323069 and 4323467 have further improved machinability. The machinabilities thereof are improved by decreasing amount of phosphorus. That is, the dispersion amount of the hard iron-phosphorus-carbon compound phase is decreased to only the amount that is required for maintaining wear resistance of a valve guide. These sintered materials have been mounted in automobiles and have started to be commercially used by domestic and international automobile manufacturers.

Recently, requirements for reducing the production costs have been increasing for various industrial machine parts, and also the requirements for reducing the production costs have been increasing for automobile parts. In view of these circumstances, further reduction of the production costs is also required for sintered materials for valve guides for internal combustion engines.

In the meantime, there are trends toward improving the performance and the fuel efficiency of automobile internal combustion engines in recent years. In accordance with the trends, valve guides have been subjected to higher temperatures and higher pressures while internal combustion engines are running. Moreover, in view of recent environmental issues, amounts of lubricant supplied to an interface between a valve guide and a valve stem have been decreased. Therefore, valve guides must withstand more severe sliding conditions. In view of these circumstances, a sintered material for valve guides is required to have high wear resistance equivalent to those of the sintered materials disclosed in Japanese Examined Patent Publication No. 55-034858 and Japanese Patent No. 2680927.

SUMMARY OF THE INVENTION

Accordingly, an object of the present invention is to provide a sintered material for valve guides and to provide a production method therefor. The sintered material is produced at low production cost and has wear resistance equivalent to those of the conventional sintered materials, that is, the sintered materials disclosed in Japanese Examined Patent Publication No. 55-034858 and Japanese Patent No. 2680927.

In order to achieve the above object, the present invention provides a sintered material for valve guides, consisting of, by mass %, 0.01 to 0.3% of P, 1.3 to 3% of C, 1 to 4% of Cu, and the balance of Fe and inevitable impurities. The sintered material exhibits a metallic structure made of pores and a matrix. The matrix is a mixed structure of a pearlite phase, a ferrite phase, an iron-phosphorus-carbon compound phase, and a copper phase. A part of the pores includes graphite that is dispersed therein. The iron-phosphorus-carbon compound phase is dispersed at 3 to 25% by area ratio and the copper phase is dispersed at 0.5 to 3.5% by area ratio with respect to a cross section of the metallic structure, respectively.

In the sintered material for valve guides of the present invention, the iron-phosphorus-carbon compound phase can be observed as a plate-shaped iron-phosphorus-carbon compound having an area of not less than 0.05% in a visual field in a cross-sectional structure at 200-power magnification. In this case, when a total area of the plate-shaped iron-phosphorus-carbon compounds having an area of not less than 0.15% in the above visual field is 3 to 50% with respect to a total area of the plate-shaped iron-phosphorus-carbon compounds, wear resistance is improved. In the present invention, iron carbides are also precipitated in addition to the iron-phosphorus-carbon compounds. However, the iron carbides are difficult to distinguish from the iron-phosphorus-carbon compounds by the metallic structure. Therefore, in the following descriptions and the descriptions in the claims, the phrase "iron-phosphorus-carbon compound" includes the iron carbide.

In addition, at least one kind selected from the group consisting of manganese sulfide particles, magnesium silicate mineral particles, and calcium fluoride particles are preferably dispersed in particle boundaries of the matrix and in the pores at not more than 2 mass %.

The present invention provides a production method for the sintered material for valve guides, and the production method includes preparing an iron powder, an iron-phosphorus alloy powder, a copper powder, and a graphite powder. The production method also includes mixing the iron-phosphorus alloy powder, the copper powder, and the graphite powder with the iron powder into a raw powder consisting of, by mass %, 0.01 to 0.3% of P, 1.3 to 3% of C, 1 to 4% of Cu, and the balance of Fe and inevitable impurities. The production method also includes filling a tube-shaped cavity of a die assembly with the raw powder, and compacting the raw powder into a green compact having a tube shape. The production method further includes sintering the green compact at a heating temperature of 970 to 1070° C. in a nonoxidizing atmosphere so as to obtain a sintered compact.

In the production method for the sintered material for valve guides of the present invention, the green compact is preferably held at the heating temperature for 10 to 90 minutes in the sintering. Moreover, the sintered compact is cooled from the heating temperature to room temperature after the sintering, and the cooling rate is preferably 5 to 25° C. per minute while the sintered compact is cooled from 850 to 600° C. In addition, when the sintered compact is cooled from the heating temperature to room temperature, the sintered compact is preferably isothermally held in a temperature range of 850 to 600° C. for 10 to 90 minutes and is then cooled. In the mixing of the powders, at least one kind selected from the group consisting of a manganese sulfide powder, a magnesium silicate mineral powder, and a calcium fluoride powder is preferably added to the raw powder at not more than 2 mass %.

According to the sintered material for valve guides of the present invention, phosphorus is not used, and thereby reducing the production cost. Moreover, predetermined amounts of the iron-phosphorus-carbon compound phase and the copper phase are dispersed, whereby the sintered material has high wear resistance and sufficient strength. The wear resistance is equivalent to those of the conventional sintered materials. The strength is at a level that is required in a case of using the sintered material as a valve guide. According to the production method for the sintered material for valve guides of the present invention, the sintered material for valve guides of the present invention can be produced as easily as in a conventional manner.

BRIEF DESCRIPTION OF THE DRAWINGS

FIG. 1A is a photograph of the metallic structure, and FIG. 1B is a schematic view of the photograph of the metallic structure of FIG. 1A.

FIG. 2A is a photograph of the metallic structure, and FIG. 2B is a schematic view of the photograph of the metallic structure of FIG. 2A, which was processed so as to extract an iron-phosphorus-carbon compound phase.

FIG. 3A is a photograph of the metallic structure, and FIG. 3B is a schematic view of the photograph of the metallic structure of FIG. 3A.

PREFERRED EMBODIMENTS OF THE INVENTION

In a sintered material for valve guides, it is important to improve wear resistance, and it is also important to decrease wear amount of a valve stem as a mating material. In view of this, in the sintered material disclosed in Japanese Examined Patent Publication No. 55-034858, by dispersing hard iron-phosphorus-carbon compounds in the matrix, the wear resistance is improved. Moreover, by dispersing a soft copper-tin alloy phase in the matrix, wear characteristics with respect to a mating material (valve stem) is decreased, and adaptability to the mating material (valve stem) is improved.

According to the sintered material for valve guides and the production method therefor in the present invention, in order to reduce the production cost, a relatively expensive copper-tin alloy powder is not used. Alternately, a relatively inexpensive copper powder is used, and a copper phase is dispersed in the matrix. The copper phase is formed by controlling the diffusion condition of Cu from the copper powder to the matrix, and the dispersion amount of the copper phase is controlled. In this case, a part amount of Cu in the copper powder is not diffused and is made to remain in the matrix. Thus, by controlling the diffusion amount of Cu in the matrix, an iron-phosphorus-carbon compound phase is obtained even when the amount of P is decreased to a degree disclosed in Japanese Patents Nos. 4323069 and 4323467. Moreover, the size and the amount of the iron-phosphorus-carbon compound phase are equivalent to those of the sintered material disclosed in Japanese Examined Patent Publication No. 55-034858.

The sintered material for valve guides and the production method therefor in the present invention will be described in detail hereinafter.

Figure 1A:
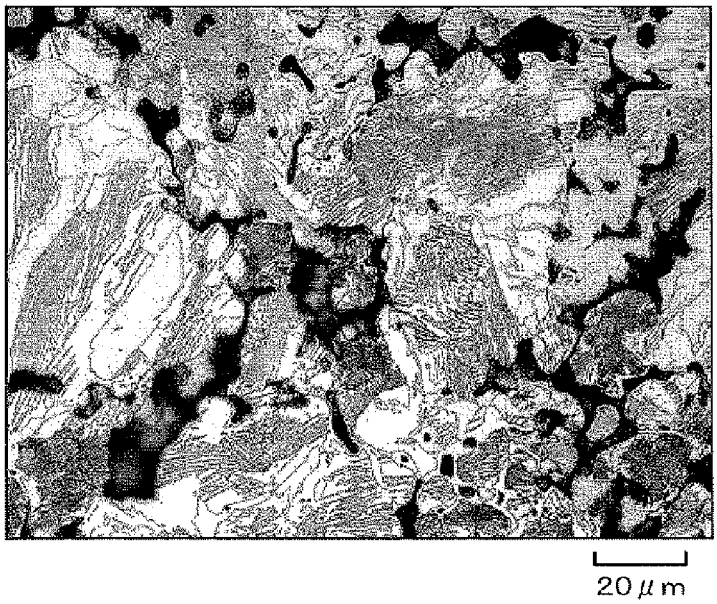
FIGS. 1A and 1B show a metallic structure of a sintered material for valve guides of the present invention, which was etched with a nital.
Figure 1B:
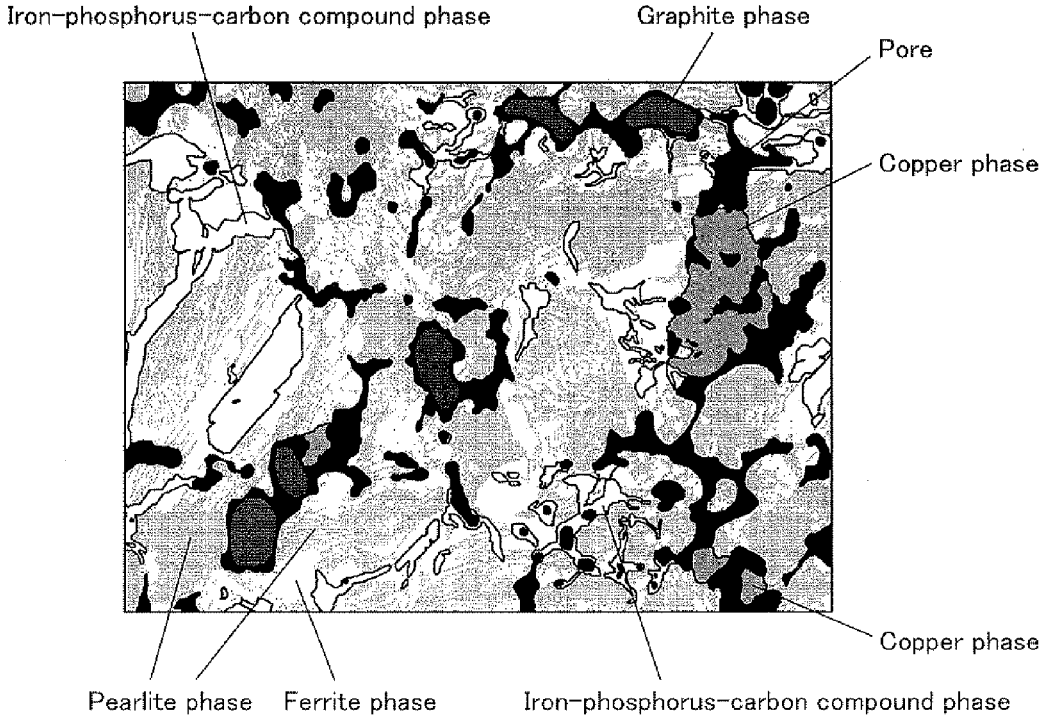

A metallic structure of a cross section of a sintered material for valve guides of the present invention is shown in FIGS. 1A and 1B. The cross-sectional structure was mirror polished and was etched with a nital (a solution of 1 mass % of nitric acid and alcohol). FIG. 1A is a photograph of the metallic structure, and FIG. 1B is a schematic view of the photograph of the metallic structure. As shown in FIGS. 1A and 1B, the metallic structure of the sintered material for valve guides of the present invention is made of pores and a matrix, and the pores are dispersed in the matrix. The pores were generated by spaces that remained among raw powder particles when the raw powder was compacted. The matrix (iron matrix) was mainly made of an iron powder in the raw powder. The matrix is a mixed structure of a pearlite phase, a ferrite phase, an iron-phosphorus-carbon compound phase, and a copper phase. In the photograph of the metallic structure shown in FIG. 1A, since a graphite phase was exfoliated when the sample was polished so as to observe the metallic structure, the graphite phase is not observed. However, as shown in the schematic view of FIG. 1B, graphite remained inside the large pores and is dispersed as a graphite phase.

Figure 3A:
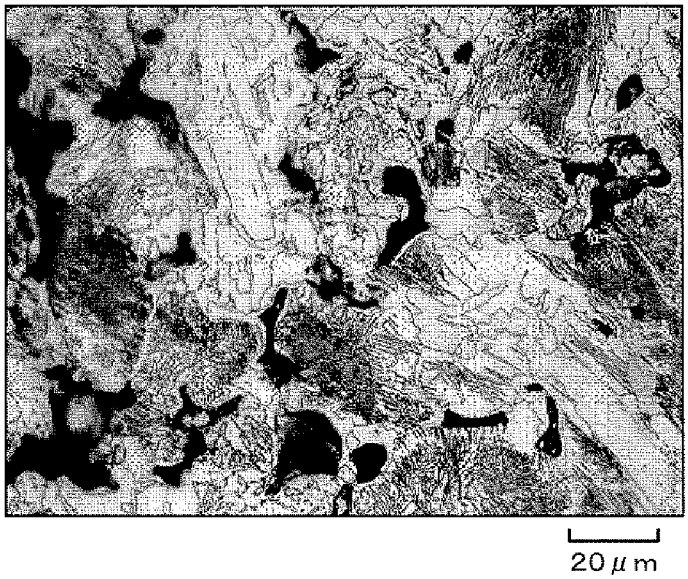
FIGS. 3A and 3B show a metallic structure of a conventional sintered material for valve guides.
Figure 3B:
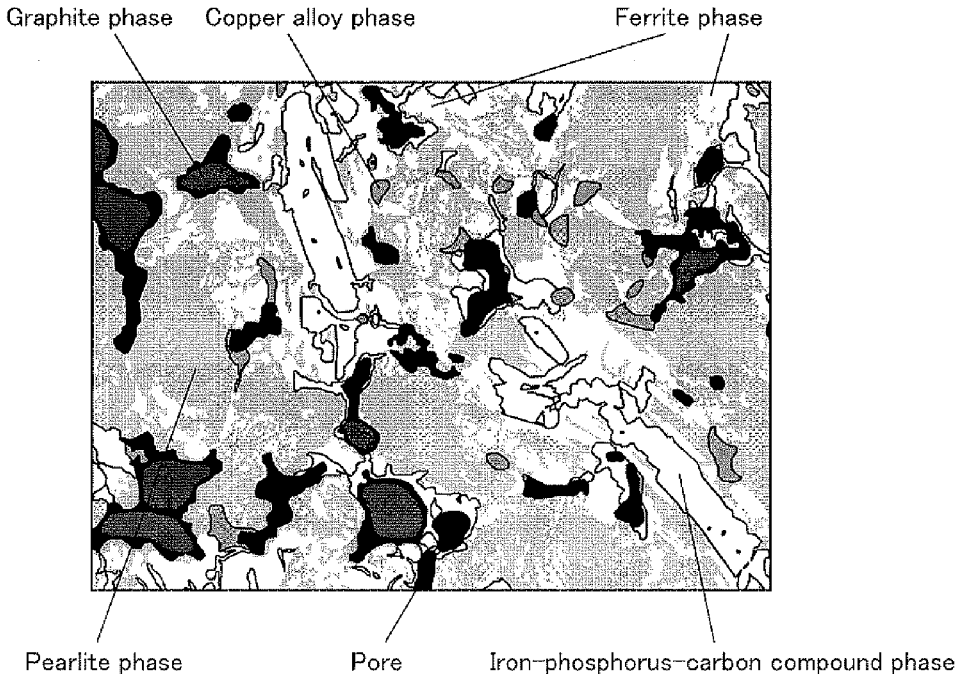

The iron-phosphorus-carbon compound phase grew in the shape of plates, and the shape and the amount thereof were approximately the same as those of the conventional sintered material shown in FIGS. 3A and 3B. The copper phase was formed by controlling the diffusion condition of Cu from the copper powder to the matrix, and a part of the copper powder was not dispersed and was made to remain in the matrix, as described above. As shown in FIGS. 1A and 1B, the copper phase exists in a condition in which a part of the amount of the copper powder is not dispersed and remains in the matrix.

Figure 2A:
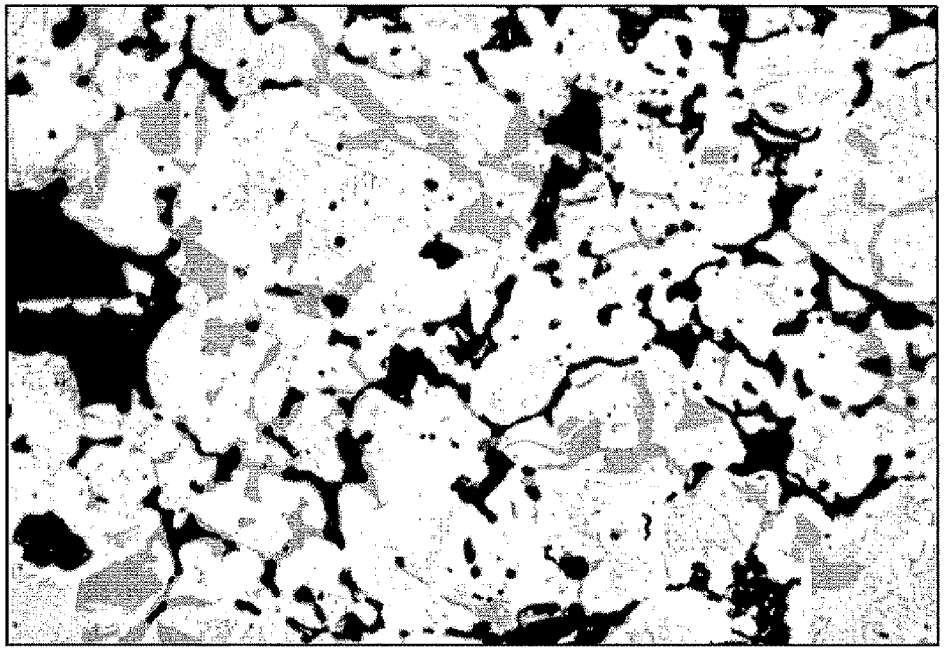
FIGS. 2A and 2B show a metallic structure of a sintered material for valve guides of the present invention, which was etched with Murakami's reagent.
Figure 2B:
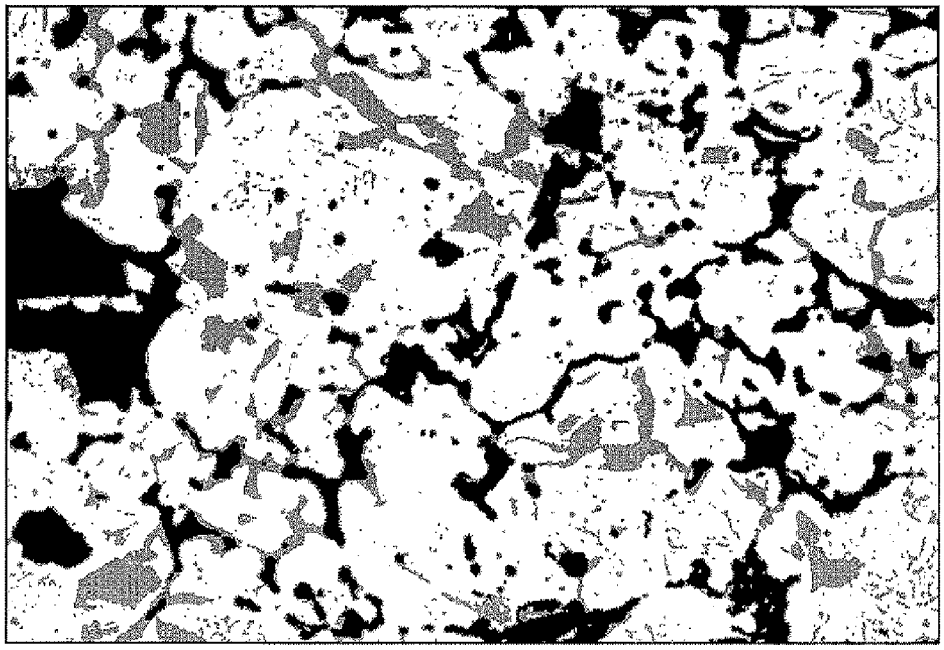

FIG. 2A shows a photograph of a metallic structure of the sintered material shown in FIGS. 1A and 1B. The sintered material was etched with Murakami's reagent (a solution of 10 mass % of potassium ferricyanide and 10 mass % of potassium hydroxide). FIG. 2B is a schematic view obtained by analyzing the photograph of FIG. 2A. As shown in FIGS. 2A and 2B, the plate-shaped iron-phosphorus-carbon compound phase was deeply etched (the gray colored portion), and the pearlite phase was lightly etched (the white colored portion). The black portions shown in FIGS. 2A and 2B are the pores. Accordingly, the plate-shaped iron-phosphorus-carbon compound phase can be distinguished from iron carbides ($Fe_3C$) that form the pearlite.

In the sintered material for valve guides of the present invention, the copper phase is essential for decreasing the wear characteristic with respect to a mating material (valve stem) and for improving the adaptability to the mating material (valve stem). When the amount of the copper phase dispersed in the matrix is less than 0.5% by area ratio in a cross-sectional metallic structure, these effects are not sufficiently obtained. These effects are increased with the increase of the amount of the copper phase dispersed in the matrix. Nevertheless, when the amount of the copper phase dispersed in the matrix is at a predetermined degree or more, these effects are not greatly increased for the amount. On the other hand, although it is necessary to increase the amount of Cu so as to increase the amount of the copper phase, the production cost is increased with the increase of the amount of Cu. From these points, the upper limit of the amount of the copper phase dispersed in the matrix is set to be 3.5% by area ratio in a cross-sectional metallic structure.

Cu is added in the form of a copper powder and forms the copper phase. In addition, Cu is diffused in the matrix and fixes the copper phase to the matrix, and Cu is solid solved in the matrix and improves the strength of the matrix. In order to obtain these effects, not less than 1 mass % of Cu is required in the entire composition. In the present invention, the copper powder is added to a raw powder, and a part of the copper powder is made not to disperse and is made to remain in the matrix, whereby the copper phase is formed. Therefore, according to the increase of the diffusion amount of Cu, the amount of Cu that remains as the copper phase is decreased. When the diffusion amount of Cu is increased, the effect for fixing the copper phase to the matrix and the effect for improving the strength of the matrix are increased. In this case, in view of using the sintered material as a valve guide for an internal combustion engine, the sintered material is required to have a compressive strength of at least 500 MPa for practical use. Therefore, it is not necessary to diffuse a great amount of Cu in the matrix. Accordingly, by diffusing a necessary and sufficient amount of Cu in the matrix, and by not diffusing the rest amount of Cu so as to form the copper powder, the production cost is reduced. Thus, the upper limit of the amount of Cu is set to be 4 mass % in the entire composition. Accordingly, the amount of Cu is set to be 1 to 4 mass % in the entire composition. The amount of the copper powder to be added to the raw powder is set to be 1 to 4 mass %.

As described above, by diffusing a necessary and sufficient amount of Cu into the matrix from the copper powder added to the raw powder, and by not diffusing the rest amount of Cu, the copper phase is formed. In this case, a heating temperature (sintering temperature) in a sintering is important. Cu has a melting point of 1084.5° C. If the raw powder is sintered at a temperature of more than the melting point, the entire amount of the copper powder in the raw powder is melted and is dispersed into the iron matrix, whereby the copper powder cannot remain as a copper phase. Even if the heating temperature is not more than the melting point, when the heating temperature is high in the sintering, the diffusion amount of Cu into the matrix is increased. Therefore, in order to diffuse a necessary and sufficient amount of Cu, the upper limit of the heating temperature is set to be 1070° C. in the sintering. On the other hand, when the heating temperature is low in the sintering, not only the diffusion of Cu, but also diffusion bonding of the iron powder particles and diffusions of the other elements (P, C) are insufficient. Therefore, the strength and the wear resistance are decreased. Accordingly, the lower limit of the heating temperature is set to be 970° C. in the sintering. In this temperature range, Cu does not generate a liquid phase, and a part amount of Cu is solid phase diffused to the matrix.

P forms a hard iron-phosphorus-carbon compound and improves the wear resistance of the sintered material for valve guides. When the amount of P is too great in the entire composition, the amount of the hard iron-phosphorus-carbon compounds is increased, and a mating material may be easily worn. Moreover, the sintered material is embrittled, and the strength is decreased. Therefore, the upper limit of the amount of P is set to be 0.3 mass %. According to the invention disclosed in Japanese Examined Patent Publication No. 55-034858, in order to obtain a predetermined amount of the iron-phosphorus-carbon compounds, the lower limit of the amount of P is set to be 0.1 mass %. In contrast, in the present invention, Sn is not used, and Cu is used by controlling the diffusion condition as described above. Therefore, the lower limit of the amount of P can be extended to 0.01 mass %.

Cu is an element for decreasing the critical cooling rate of a steel and improves hardenability of the steel. That is, Cu shifts the pearlite nose to the later time side (right side) in the continuous cooling transformation diagram. Therefore, when the sintered material is cooled from the heating temperature in a condition that Cu having such effects is uniformly diffused at a predetermined amount in the iron matrix, the pearlite nose is shifted to the later time side. As a result, the hardenability of the iron matrix is improved, and the sintered material is cooled at a cooling rate in an ordinary sintering furnace before the iron-phosphorus-carbon compounds grow sufficiently. Accordingly, when the amount of P is small, the amount of the iron-phosphorus-carbon compounds as cores is decreased, whereby a fine pearlite structure is easily formed.

On the other hand, when the diffusion amount of Cu in the matrix is limited to the necessary and sufficient amount as described above, the matrix has portions including high and low concentration of Cu and not uniformly includes Cu. In the portion including low concentration of Cu, the effect of Cu for improving the hardenability is decreased. Therefore, in the portion including low concentration of Cu, the iron-phosphorus-carbon compounds sufficiently grow by absorbing the surrounding C in the cooling after the sintering, even when the amount of P is small and the amount of the iron-phosphorus-carbon compounds as cores is small. Accordingly, although the amount of P is decreased, iron-phosphorus-carbon compounds are obtained at sizes and amount that are equivalent to those of the sintered material disclosed in Japanese Examined Patent Publication No. 55-034858.

The iron-phosphorus-carbon compound grows by absorbing the surrounding C and also grows by combining with and absorbing adjacent iron-phosphorus-carbon compounds. Therefore, in the vicinity of the iron-phosphorus-carbon compound, the amount of C is decreased, and a ferrite phase is dispersed.

When the amount of the iron-phosphorus-carbon compound phase is small, the wear resistance is decreased. Therefore, the amount of the iron-phosphorus-carbon compound phase is required to be not less than 3% by area ratio with respect to a metallic structure including pores in cross-sectional observation. In contrast, when the amount of the iron-phosphorus-carbon compound phase is too great, the degree of wear characteristics with respect to a mating material (valve stem) is increased, whereby the mating material may be worn. In addition, strength of a valve guide is decreased, and machinability of a valve guide is decreased. Therefore, the upper limit of the amount of the iron-phosphorus-carbon compound phase is set to be 25%. It should be noted that the pearlite has a lamellar structure of fine iron carbides and ferrite, and the pearlite is difficult to strictly separate from the iron-phosphorus-carbon compound. Nevertheless, the plate-shaped iron-phosphorus-carbon compound of the present invention is identified in a cross-sectional metallic structure as the dark colored portion as shown in FIG. 2B. In this case, image analyzing software, such as "WinROOF" produced by Mitani Corporation, may be used. The dark colored portion, that is, the iron-phosphorus-carbon compound phase is separately extracted by controlling a threshold. Therefore, the area ratio of the iron-phosphorus-carbon compound phase can be measured by analyzing the area of the dark colored portions.

When the above image analysis is performed, each of the iron-phosphorus-carbon compounds is recognized as a portion having an area of not less than 0.05% in a visual field of a cross-sectional structure at 200-power magnification as described above. Accordingly, the area ratio of the iron-phosphorus-carbon compound phase also can be measured by adding up the areas of the portions having an area of not less than 0.05%. The area ratio of the plate-shaped iron-phosphorus-carbon compound phase is set to be the above area ratio in cross section. Moreover, as already described above, in view of the wear resistance, the amount of large plate-shaped iron-phosphorus-carbon compounds is preferably 3 to 50% with respect to the entire amount of the plate-shaped iron-phosphorus-carbon compounds. In this case, the large plate-shaped iron-phosphorus-carbon compounds have an area of not less than 0.15%, which is measured in a visual field of a cross-sectional structure at 200-power magnification.

P is added in the form of an iron-phosphorus alloy powder. For example, a copper-phosphorus alloy powder cannot be used. A copper-phosphorus alloy powder including 1.7 to less than 14 mass % of P generates a liquid phase at 714° C. A copper-phosphorus alloy powder including 14 mass % of P generates a liquid phase at 1022° C. That is, the copper-phosphorus alloy powder easily generates a liquid phase at the above heating temperature in the sintering. Therefore, the copper-phosphorus alloy powder reacts with the copper powder, and a liquid phase is generated by the copper powder. On the other hand, an iron-phosphorus alloy powder consisting of 2.8 to 15.6 mass % of P and the balance of Fe generates a liquid phase at 1050° C. An iron-phosphorus alloy powder consisting of 15.6 to 21.7 mass % of P and the balance of Fe generates a liquid phase at 1166° C. Therefore, the latter iron-phosphorus alloy powder does not generate a liquid phase in the heating temperature range in the sintering, and Cu is solid phase diffused from the copper powder to the matrix as described above. In view of variation of the temperature in a sintering furnace, the iron-phosphorus alloy powder including 15.6 to 21.7% of P is preferably used so as not to generate a liquid phase even when the temperature slightly varies.

C is essential for forming the iron-phosphorus-carbon compound phase, the pearlite phase, and the graphite phase that can be used as a solid lubricant. Therefore, the amount of C is set to be not less than 1.3 mass %. In this case, C is added in the form of a graphite powder. If the amount of the graphite powder is more than 3.0 mass % in the raw powder, flowability, fillability, and compressibility of the raw powder are greatly decreased, and the sintered material is difficult to produce. Accordingly, the amount of C in the sintered material is set to be 1.3 to 3.0 mass %.

The entire amount of C is added in the form of the graphite powder. Therefore, the graphite powder is added to the raw powder at 1.3 to 3.0 mass %. A part of the amount of C added in the form of the graphite powder is diffused and is solved in the matrix (austenite) at the heating temperature in the sintering. The residual amount of C remains as a graphite phase which functions as a solid lubricant. When the sintered compact in such conditions is cooled, in the portion having low concentration of Cu in the iron matrix, the effect for improving the hardenability of the iron matrix is decreased. Therefore, the pearlite nose is not greatly shifted to the later time side in the continuous cooling transformation diagram. As a result, the iron carbides precipitated from the austenite easily grow in the cooling after the sintering, and the iron-phosphorus-carbon compounds grow even when the amount of P is not more than 0.3 mass %.

The diffusions of the elements of Cu and C are greatly affected by the heating temperature and are relatively less affected by the holding time at the heating temperature. Nevertheless, because Cu and C may not be sufficiently diffused if the holding time is too short in the sintering, the holding time is preferably set to be not less than 10 minutes. On the other hand, because Cu may be too diffused if the holding time is too long in the sintering, the holding time is preferably set to be not more than 90 minutes.

After the sintering, while the sintered compact is cooled from the heating temperature to room temperature, the sintered compact is preferably cooled from 850 to 600° C. at a cooling rate of not more than 25° C./minute. In this case, the precipitated iron-phosphorus-carbon compounds tend to grow in the shape of plates. On the other hand, if the cooling rate is too low, a long time is required for the cooling and thereby the production cost is increased. Therefore, the cooling rate is preferably not less than 5° C./minute in the temperature range of 850 to 600° C.

In addition, in the cooling from the heating temperature to room temperature after the sintering, the sintered compact may be isothermally held at a temperature during cooling from 850 to 600° C. and may be then cooled. By the isothermal holding, the precipitated iron-phosphorus-carbon compounds grow in the shape of plates. In this case, the isothermal holding time is preferably not less than 10 minutes. On the other hand, if the isothermal holding time is too long, a long time is required for the cooling, and thereby the production cost is increased. Therefore, the isothermal holding time is preferably not more than 90 minutes in the temperature range of 850 to 600° C.

As described above, the sintered material for valve guides of the present invention consists of, by mass %, 0.01 to 0.3% of P, 1.3 to 3% of C, 1 to 4% of Cu, and the balance of Fe and inevitable impurities. The sintered material exhibits a metallic structure made of pores and a matrix. The matrix is a mixed structure of a pearlite phase, a ferrite phase, an iron-phosphorus-carbon compound phase, and a copper phase. A part of the pores includes graphite that is dispersed therein. The iron-phosphorus-carbon compound phase is dispersed at 3 to 25% by area ratio and the copper phase is dispersed at 0.5 to 3.5% by area ratio, with respect to a cross section of the metallic structure, respectively.

The production method for the sintered material for valve guides of the present invention includes preparing an iron powder, an iron-phosphorus alloy powder, a copper powder, and a graphite powder. The production method also includes mixing the iron-phosphorus alloy powder, the copper powder, and the graphite powder with the iron powder into a raw powder consisting of, by mass %, 0.01 to 0.3% of P, 1.3 to 3% of C, 1 to 4% of Cu, and the balance of Fe and inevitable impurities. Then, the raw powder is filled in a tube-shaped cavity of a die assembly, and the raw powder is compacted into a green compact having a tube shape. The compacting is conventionally performed as a production step for a sintered material for valve guides. The green compact is sintered at a heating temperature of 970 to 1070° C. in a nonoxidizing atmosphere so as to obtain a sintered compact.

According to the sintered material for valve guides and the production method therefor in the present invention, the amount of P is 0.01 to 0.3 mass %, and an expensive copper-tin alloy powder is not used but a relatively inexpensive copper powder is used. Therefore, the production cost can be decreased compared to that of the conventional sintered material disclosed in Japanese Examined Patent Publication No. 55-034858. Moreover, when the amount of P is 0.01 to less than 0.1 mass %, in addition to the effect for decreasing the cost, effects due to the decrease of the amount of P are obtained.

In the sintered material for valve guides, the machinability may be improved by conventional methods such as the method disclosed in Japanese Patent No. 2680927. That is, at least one kind selected from the group consisting of a manganese sulfide powder, a magnesium silicate mineral powder, and a calcium fluoride powder may be added to the raw powder at not more than 2 mass %. Then, by compacting and sintering this raw powder, a sintered material for valve guides is obtained. This sintered material for valve guides has particle boundaries in the matrix and pores, in which at least one of manganese sulfide particles, magnesium silicate mineral particles, and calcium fluoride particles are dispersed at not more than 2 mass %. Accordingly, the machinability of the sintered material for valve guides is improved.

EXAMPLES

First Example

Effects of the amount of Cu in the entire composition on characteristics of a valve guide were investigated. First, an iron powder, an iron-phosphorus alloy powder, a copper powder, and a graphite powder were prepared. The iron-phosphorus alloy powder consisted of 20 mass % of P and the balance of Fe and inevitable impurities. The iron-phosphorus alloy powder and the copper alloy powder in the amounts shown in Table 1, and 2 mass % of the graphite powder, were added to the iron powder, and they were mixed to form a raw powder. The raw powder was compacted at a compacting pressure of 650 MPa into a green compact with a tube shape. Some of the green compacts had an outer diameter of 11 mm, an inner diameter of 6 mm, and a length of 40 mm (for a wear test). The other green compacts had an outer diameter of 18 mm, an inner diameter of 10 mm, and a length of 10 mm (for a compressive strength test). These green compacts with the tube shapes were sintered at a heating temperature of 1000° C. for 30 minutes in an ammonia decomposed gas atmosphere. Then, the sintered compacts were cooled from the heating temperature to room temperature, whereby sintered compact samples of samples Nos. 01 to 09 were formed. In the cooling, the cooling rate in the temperature range from 850 to 600° C. was 10° C./minute.

Another sintered compact sample was formed as a conventional example as follows. A copper-tin alloy powder consisting of 10 mass % of Sn and the balance of Cu and inevitable impurities, and an iron-phosphorus alloy powder consisting of 20 mass % of P and the balance of Fe and inevitable impurities, were also prepared. Then, 5 mass % of the copper-tin alloy powder, 1.4 mass % of the iron-phosphorus alloy powder, and 2 mass % of the graphite powder were added to the iron powder, and they were mixed to form a raw powder. This raw powder was also compacted into two kinds of green compacts having the above shapes and was sintered under the above sintering conditions, whereby a sintered compact sample of sample No. 10 was obtained. This conventional example corresponds to the sintered material disclosed in Japanese Examined Patent Publication No. 55-034858. The entire compositions of these sintered compact samples are shown in Table 1.

TABLE 1

| Sample | Mixing ratio mass % | | | | | Composition mass % | | | | | |
|---|---|---|---|---|---|---|---|---|---|---|---|
| No. | Iron powder | Iron-phosphorus alloy powder | Copper powder | Copper-tin alloy powder | Graphite powder | Fe | P | Cu | Sn | C | Notes |
| 01 | Bal. | 0.80 | 0.50 | — | 2.00 | Bal. | 0.16 | 0.50 | — | 2.00 | Exceeds lower limit of amount of Cu |
| 02 | Bal. | 0.80 | 1.00 | — | 2.00 | Bal. | 0.16 | 1.00 | — | 2.00 | Lower limit of amount of Cu |
| 03 | Bal. | 0.80 | 1.50 | — | 2.00 | Bal. | 0.16 | 1.50 | — | 2.00 | |
| 04 | Bal. | 0.80 | 2.00 | — | 2.00 | Bal. | 0.16 | 2.00 | — | 2.00 | |
| 05 | Bal. | 0.80 | 2.50 | — | 2.00 | Bal. | 0.16 | 2.50 | — | 2.00 | |
| 06 | Bal. | 0.80 | 3.00 | — | 2.00 | Bal. | 0.16 | 3.00 | — | 2.00 | |
| 07 | Bal. | 0.80 | 3.50 | — | 2.00 | Bal. | 0.16 | 3.50 | — | 2.00 | |

TABLE 1-continued

| Sample No. | Mixing ratio mass % Iron powder | Iron-phosphorus alloy powder | Copper powder | Copper-tin alloy powder | Graphite powder | Composition mass % Fe | P | Cu | Sn | C | Notes |
|---|---|---|---|---|---|---|---|---|---|---|---|
| 08 | Bal. | 0.80 | 4.00 | — | 2.00 | Bal. | 0.16 | 4.00 | — | 2.00 | Upper limit of amount of Cu |
| 09 | Bal. | 0.80 | 4.50 | — | 2.00 | Bal. | 0.16 | 4.50 | — | 2.00 | Exceeds upper limit of amount of Cu |
| 10 | Bal. | 1.40 | — | 5.00 | 2.00 | Bal. | 0.28 | 4.50 | 0.50 | 2.00 | Conventional alloy |

In these sintered compact samples, wear amounts of valve guides and wear amounts of valve stems were measured by the wear test, and compressive strength was measured by the compressive strength test. In addition, an area ratio of an iron-phosphorus-carbon compound phase and an area ratio of a copper phase were measured by observing a cross section of a metallic structure.

The wear test was performed as follows by using a wear testing machine. The sintered compact sample having the tube shape was secured to the wear testing machine, and a valve stem of a valve was inserted into the sintered compact sample. The valve was mounted at a lower end portion of a piston that would be vertically reciprocated. Then, the valve was reciprocated at a stroke speed of 3000 times/minute and at a stroke length of 8 mm at 500° C. in an exhaust gas atmosphere, and at the same time, a lateral load of 5 MPa was applied to the piston. After the valve was reciprocated for 30 hours, wear amount (in μm) of the inner circumferential surface of the sintered compact and wear amount (in μm) of the outer circumferential surface of the valve stem were measured.

The area ratio of the copper phase was measured as follows. The cross section of the sample was mirror polished and was etched with a nital. This metallic structure was observed by a microscope at 200-power magnification and was analyzed by using image analyzing software "WinROOF" that is produced by Mitani Corporation. Thus, the area of the copper phases was measured so as to obtain an area ratio. The area ratio of the iron-phosphorus-carbon compound phase was measured in the same manner as in the case of the area ratio of the copper phase except that Murakami's reagent was used as the etching solution. The area of each phase identified by the image analysis is not less than 0.05% with respect to the visual field.

These results are shown in Table 2. It should be noted that the total of the wear amounts of the valve guide and the valve stem is represented by the symbol "Total" in the Tables. The samples were evaluated based on acceptable levels to use as a valve guide. That is, the target level of the compressive strength is approximately not less than 500 MPa, and the target level of the wear amount is not more than 75 μm in the total wear amount.

TABLE 2

| Sample No. | Area ratio of iron-phosphorus-carbon compound phase % | Area ratio of copper phase % | Compressive strength | Wear amount μm Valve guide | Valve stem | Total | Notes |
|---|---|---|---|---|---|---|---|
| 01 | 19.20 | 0.20 | 473 | 91 | 9 | 100 | Exceeds lower limit of amount of Cu |
| 02 | 19.00 | 0.50 | 532 | 67 | 2 | 69 | Lower limit of amount of Cu |
| 03 | 18.50 | 0.80 | 559 | 63 | 1 | 64 | |
| 04 | 18.70 | 1.50 | 606 | 60 | 2 | 62 | |
| 05 | 18.20 | 2.00 | 637 | 62 | 2 | 64 | |
| 06 | 13.60 | 2.30 | 646 | 64 | 2 | 66 | |
| 07 | 9.00 | 2.80 | 673 | 67 | 2 | 69 | |
| 08 | 4.50 | 3.30 | 730 | 71 | 2 | 73 | Upper limit of amount of Cu |
| 09 | 2.60 | 3.60 | 754 | 81 | 3 | 84 | Exceeds upper limit of amount of Cu |
| 10 | 17.70 | 3.20 | 680 | 61 | 2 | 63 | Conventional alloy |

The compressive strength test was performed as follows according to the method described in Z2507 specified by the Japanese Industrial Standard. A sintered compact sample with a tube shape had an outer diameter of D (mm), a wall thickness of e (mm), and a length of L (mm). The sintered compact sample was radially pressed by increasing the pressing load, and a maximum load F (N) was measured when the sintered compact sample broke. Then, a compressive strength K (N/mm$^2$) was calculated from the following first formula.

$$K=F\times(D-e)/(L\times e^2) \quad \text{First formula}$$

According to the samples of the samples Nos. 01 to 09 in Table 2, the effects of the amount of Cu in the entire composition of the sintered material and the effects of the amount of the copper powder in the raw powder are shown. In the samples of the samples Nos. 01 to 05 including not more than 2.5 mass % of Cu (the copper powder), the area ratio of the plate-shaped iron-phosphorus-carbon compound phase in the cross sectional metallic structure was slightly decreased with the increase of the amount of Cu. In this case, the amounts of the iron-phosphorus-carbon compounds were approximately the same as that of the conventional example (sample No. 10).

On the other hand, when the amount of Cu (the copper powder) was more than 2.5 mass %, the area ratio of the plate-shaped iron-phosphorus-carbon compound phase was suddenly decreased in the cross sectional metallic structure. In the sample of the sample No. 08 including 4.0 mass % of Cu, the area ratio of the plate-shaped iron phosphorus-carbon compound phase was decreased to 4.5%. Moreover, in the sample of the sample No. 09 including more than 4.0 mass % of Cu, the area ratio of the iron-phosphorus carbon compound phase was decreased to 2.6%.

The copper phase were increased in proportion to the amount of Cu (the copper powder). In the sample of the sample No. 01 including 0.5 mass % of Cu (the copper powder), the area ratio of the copper phase was 0.2% in the cross-sectional metallic structure. In the sample of the sample No. 08 including 4.0 mass % of Cu (the copper powder), the area ratio of the copper phase was increased to 3.3%. Moreover, in the sample of the sample No. 09 including more than 4.0 mass % of Cu (the copper powder), the area ratio of the copper phase was increased to 3.6%.

In the sample of the sample No. 01 including 0.5 mass % of Cu (the copper powder), since the amount of Cu was small, the strength of the matrix was low, and the compressive strength was low. According to the increase in the amount of Cu (the copper powder), the effect of Cu for strengthening the matrix was increased. Therefore, the compressive strength was increased in proportion to the amount of Cu (the copper powder). In the sample of the sample No. 01 including less than 1.0 mass % of Cu (the copper powder), the compressive strength was low, whereby this sample cannot be used as a valve guide. On the other hand, in the samples of the samples Nos. 02 to 09 including not less than 1.0 mass % of Cu (the copper powder), the compressive strength was not less than 500 MPa, and the strength was at an acceptable level sufficient to use as a valve guide.

In the sample of the sample No. 01 including 0.5 mass % of Cu (the copper powder), since the copper phase for improving the adaptability was not included, the valve stem was slightly worn. On the other hand, in the sample of the sample No. 02 including 1.0 mass % of Cu (the copper powder), the copper phase was dispersed and thereby the adaptability was improved. Therefore, the wear amount of the valve stem was decreased. Moreover, in the samples of the samples Nos. 03 to 09 including not less than 1.5 mass % of Cu (the copper powder), sufficient amount of the copper phase was dispersed, whereby the wear amount of the valve stem was low and was constant.

In the sample of the sample No. 01 including 0.5 mass % of Cu (the copper powder), since the amount of Cu was small, the strength of the matrix was low. Therefore, the wear amount of the valve guide was great, and the total wear amount was large. In contrast, in the sample of the sample No. 02 including 1.0 mass % of Cu (the copper powder), the strength of the matrix was improved by the effect of Cu. Therefore, the wear amount of the valve guide was decreased, and the total wear amount was also decreased. In the samples of the samples Nos. 03 to 06 including 1.5 to 3.0 mass % of Cu (the copper powder), the effect of Cu for strengthening the matrix was sufficiently obtained, and the precipitation amount of the plate-shaped iron-phosphorus-carbon compounds were great. Accordingly, the wear amounts of the valve guides were approximately the same as that of the conventional example (sample No. 10) and were approximately constant and low. As a result, the total wear amounts were also approximately the same as that of the conventional example (sample No. 10) and were approximately constant and low. On the other hand, in the samples of the samples Nos. 07 and 08 including 3.5 to 4.0 mass % of Cu (the copper powder), the influence of the decrease in the amount of the plate-shaped iron-phosphorus-carbon compounds was greater than the effect of Cu for strengthening the matrix. Therefore, the wear resistances were decreased, and the wear amounts of the valve guides were slightly increased. In the sample of the sample No. 09 including more than 4.0 mass % of Cu (the copper powder), the wear resistance was greatly decreased due to the decrease in the amount of the plate-shaped iron-phosphorus-carbon compounds. As a result, the wear amount of the valve guide was increased, and the total wear amount was greatly increased.

According to the above results, when the amount of Cu (the copper powder) was 1.0 to 4.0 mass %, the wear resistances of the sintered compacts were approximately equal to that of the sintered material disclosed in Japanese Examined Patent Publication No. 55-034858. In addition, when the amount of Cu was in this range, the sintered compacts had strength at an acceptable level to use as a valve guide. The area ratio of the copper phase was 0.5 to 3.3% in the cross-sectional metallic structure when the amount of Cu was in this range. In this case, the area ratio of the plate-shaped iron-phosphorus-carbon compound phase was required to be approximately not less than 3% in the cross-sectional metallic structure.

Second Example

Effects of the amount of C in the entire composition on the characteristics of a valve guide were investigated. The iron powder, the iron-phosphorus alloy powder, the copper powder, and the graphite powder, which were used in the First Example, were prepared. Then, the iron-phosphorus alloy powder, the copper powder, and the graphite powder, which were in the amounts shown in Table 3, were added to the iron powder, and they were mixed to form a raw powder. The raw powder was compacted and was sintered in the same conditions as in the First Example, whereby samples of samples Nos. 11 to 16 were formed. The entire compositions of these samples are also shown in Table 3. In these samples, the wear test and the compressive strength test were performed under the same conditions as those in the First Example. Moreover, the area ratio of the iron-phosphorus-carbon compound phase and the area ratio of the copper phase were measured. These results are shown in Table 4. It should be noted that the values of the sample of the sample No. 04 in the First Example are also shown in Tables 3 and 4 as an example including 2 mass % of the graphite powder.

TABLE 3

| Sample No. | Mixing ratio mass % Iron powder | Iron-phosphorus alloy powder | Copper powder | Graphite powder | Composition mass % Fe | P | Cu | C | Notes |
|---|---|---|---|---|---|---|---|---|---|
| 11 | Bal. | 0.80 | 2.00 | 1.00 | Bal. | 0.16 | 2.00 | 1.00 | Exceeds lower limit of amount of C |

TABLE 3-continued

| Sample No. | Mixing ratio mass % Iron powder | Iron-phosphorus alloy powder | Copper powder | Graphite powder | Composition mass % Fe | P | Cu | C | Notes |
|---|---|---|---|---|---|---|---|---|---|
| 12 | Bal. | 0.80 | 2.00 | 1.30 | Bal. | 0.16 | 2.00 | 1.30 | Lower limit of amount of C |
| 13 | Bal. | 0.80 | 2.00 | 1.50 | Bal. | 0.16 | 2.00 | 1.50 | |
| 04 | Bal. | 0.80 | 2.00 | 2.00 | Bal. | 0.16 | 2.00 | 2.00 | |
| 14 | Bal. | 0.80 | 2.00 | 2.50 | Bal. | 0.16 | 2.00 | 2.50 | |
| 15 | Bal. | 0.80 | 2.00 | 3.00 | Bal. | 0.16 | 2.00 | 3.00 | Upper limit of amount of C |
| 16 | Bal. | 0.80 | 2.00 | 3.50 | Bal. | 0.16 | 2.00 | 3.50 | Exceeds upper limit of amount of C |

TABLE 4

| Sample No. | Area ratio of iron-phosphorus-carbon compound phase % | Area ratio of copper phase % | Compressive strength | Wear amount μm Valve guide | Valve stem | Total | Notes |
|---|---|---|---|---|---|---|---|
| 11 | 0.00 | 1.40 | 867 | 85 | 5 | 90 | Exceeds lower limit of amount of C |
| 12 | 3.10 | 1.35 | 810 | 70 | 4 | 74 | Lower limit of amount of C |
| 13 | 10.30 | 1.40 | 643 | 65 | 2 | 67 | |
| 04 | 18.70 | 1.50 | 606 | 60 | 2 | 62 | |
| 14 | 23.20 | 1.55 | 537 | 59 | 2 | 61 | |
| 15 | 25.00 | 1.45 | 502 | 65 | 5 | 70 | Upper limit of amount of C |
| 16 | 28.00 | 1.45 | 410 | 83 | 10 | 93 | Exceeds upper limit of amount of C |

According to the samples of the samples Nos. 04 and 11 to 16 in Table 4, the effects of the amount of C in the entire composition of the sintered material and the effects of the amount of the graphite powder in the raw powder are shown. In the sample of the sample No. 11 including 1 mass % of C (the graphite powder), the amount of C diffused in the matrix was small, whereby the plate-shaped iron-phosphorus-carbon compound phase was not precipitated. In contrast, in the sample of the sample No. 12 including 1.3 mass % of C (the graphite powder), the amount of C diffused in the matrix was sufficient, and the area ratio of the plate-shaped iron-phosphorus-carbon compound phase was 3.1% in the cross-sectional metallic structure. According to the increase of the amount of C (the graphite powder), the area ratio of the plate-shaped iron-phosphorus-carbon compound phase was increased in the cross-sectional metallic structure. That is, in the sample of the sample No. 15 including 3 mass % of C (the graphite powder), the area ratio of the plate-shaped iron-phosphorus-carbon compound phase was 25.0%. Moreover, in the sample of the sample No. 16 including more than 3 mass % of C (the graphite powder), the area ratio of the plate-shaped iron-phosphorus-carbon compound phase was increased to 28.0%. On the other hand, the area ratio of the copper phase was constant in the cross-sectional metallic structure regardless of the amount of C (the graphite powder). This was because the amount of Cu (the copper powder) was constant and the sintering conditions were the same.

In the sample of the sample No. 11, the plate-shaped iron-phosphorus-carbon compound phase was not precipitated in the matrix, and the compressive strength was the highest. When the amount of C (the graphite powder) was increased, the amount of the iron-phosphorus-carbon compound phase precipitated in the matrix was increased, whereby the compressive strength was decreased. Nevertheless, in the sample of the sample No. 15 including 3 mass % of C (the graphite powder), the compressive strength was 502 MPa. Therefore, when the amount of C (the graphite powder) was not more than 3 mass %, the strength of the sintered compact was at an acceptable level sufficient to use as a valve guide.

In the sample of the sample No. 11 including 1 mass % of C (the graphite powder), since the iron-phosphorus-carbon compound phase for improving the wear resistance was not precipitated, the wear amount of the valve guide was great. In contrast, in the sample of the sample No. 12 including 1.3 mass % of C (the graphite powder), the plate-shaped iron-phosphorus-carbon compound was precipitated in the matrix, and the wear amount of the valve guide was decreased. According to the increase of C (the graphite powder), the amount of the plate-shaped iron-phosphorus-carbon compound phase precipitated in the matrix was increased. Therefore, the wear resistance was improved by the plate-shaped iron-phosphorus-carbon compound phase, whereby the wear amount of the valve guide was decreased. This tendency was observed until the sample of the sample No. 14 including 2.5 mass % of C (the graphite powder). On the other hand, in the sample of the sample No. 15 including 3 mass % of C (the graphite powder), since the amount of the plate-shaped iron-phosphorus-carbon compounds was greatly increased, the strength of the sintered compact sample was decreased. Therefore, the wear amount of the valve guide was slightly increased. Moreover, in the sample of the sample No. 16 including more than 3 mass % of C (the graphite powder), the wear amount of the valve guide was greatly increased. Since the amount of the hard plate-shaped iron-phosphorus-carbon compound phase precipitated in the matrix was increased with the increase of C (the graphite powder), the wear amount of the valve stem was increased with the increase of C (the graphite powder) from 2.5 mass %. According to these wear conditions, the total wear amount was decreased when the amount of C (the graphite powder) was in the range of 1.3 to 3 mass %.

As described above, when the amount of C (the graphite powder) was 1.3 to 3 mass %, the wear resistances of the sintered compacts were approximately equal to that of the sintered material disclosed in Japanese Examined Patent Publication No. 55-034858. In addition, when the amount of C was in this range, the sintered compacts had strength at an acceptable level to use as a valve guide. In this case, the area ratio of the iron-phosphorus-carbon compound phase was 3 to 25% in the cross-sectional metallic structure when the amount of C was in this range.

Third Example

Effects of the amount of P in the entire composition on the characteristics of a valve guide were investigated. The iron powder, the iron-phosphorus alloy powder, the copper powder, and the graphite powder, which were used in the First Example, were prepared. Then, the iron-phosphorus alloy powder and the copper powder in the amounts shown in Table 5 and 2 mass % of the graphite powder were added to the iron powder, and they were mixed to form a raw powder. The raw powder was compacted and was sintered in the same conditions as in the First Example, whereby samples of samples Nos. 17 to 24 were formed. The entire compositions of these samples are also shown in Table 5. In these samples, the wear test and the compressive strength test were performed under the same conditions as those in the First Example. Moreover, the area ratio of the iron-phosphorus-carbon compound phase and the area ratio of the copper phase were measured. These results are shown in Table 6. It should be noted that the values of the sample of the sample No. 04 in the First Example are also shown in Tables 5 and 6 as an example including 0.8 mass % of the iron-phosphorus alloy powder.

TABLE 5

| Sample No. | Mixing ratio mass % Iron powder | Iron-phosphorus alloy powder | Copper powder | Graphite powder | Composition mass % Fe | P | Cu | C | Notes |
|---|---|---|---|---|---|---|---|---|---|
| 17 | Bal. | 0.05 | 2.00 | 2.00 | Bal. | 0.01 | 2.00 | 2.00 | Lower limit of amount of P |
| 18 | Bal. | 0.25 | 2.00 | 2.00 | Bal. | 0.05 | 2.00 | 2.00 | |
| 19 | Bal. | 0.50 | 2.00 | 2.00 | Bal. | 0.10 | 2.00 | 2.00 | |
| 04 | Bal. | 0.80 | 2.00 | 2.00 | Bal. | 0.16 | 2.00 | 2.00 | |
| 20 | Bal. | 1.00 | 2.00 | 2.00 | Bal. | 0.20 | 2.00 | 2.00 | |
| 21 | Bal. | 1.25 | 2.00 | 2.00 | Bal. | 0.25 | 2.00 | 2.00 | |
| 22 | Bal. | 1.40 | 2.00 | 2.00 | Bal. | 0.28 | 2.00 | 2.00 | |
| 23 | Bal. | 1.50 | 2.00 | 2.00 | Bal. | 0.30 | 2.00 | 2.00 | Upper limit of amount of P |
| 24 | Bal. | 1.75 | 2.00 | 2.00 | Bal. | 0.35 | 2.00 | 2.00 | Exceeds upper limit of amount of P |

TABLE 6

| SampleNo. | Area ratio of iron-phosphorus-carbon compound phase % | Area ratio of copper phase % | Compressive strength | Wear amount μm Valve guide | Valve stem | Total | Notes |
|---|---|---|---|---|---|---|---|
| 17 | 18.35 | 1.40 | 622 | 61 | 1 | 62 | Lower limit of amount of P |
| 18 | 18.40 | 1.35 | 617 | 62 | 1 | 63 | |
| 19 | 18.60 | 1.45 | 610 | 61 | 2 | 63 | |
| 04 | 18.70 | 1.50 | 606 | 60 | 2 | 62 | |
| 20 | 19.20 | 1.45 | 589 | 58 | 1 | 59 | |
| 21 | 19.70 | 1.45 | 586 | 61 | 2 | 63 | |
| 22 | 20.10 | 1.50 | 583 | 62 | 1 | 63 | |
| 23 | 21.00 | 1.35 | 554 | 67 | 3 | 70 | Upper limit of amount of P |
| 24 | 21.60 | 1.40 | 483 | 77 | 5 | 82 | Exceeds upper limit of amount of P |

According to the samples of the samples Nos. 04 and 17 to 24 in Table 6, the effects of the amount of P in the entire composition of the sintered material are shown. In the samples of the samples Nos. 17 to 23 including not more than 0.3 mass % of P, the area ratio of the plate-shaped iron-phosphorus-carbon compound phase was approximately constant in the cross-sectional metallic structure and was approximately the same as that of the conventional example (sample No. 10). In these samples, the compressive strengths, and the wear amounts of the valve guides and the valve stems, were approximately the same as those of the conventional example. Thus, a sintered material having high wear resistance was obtained at low cost even when the amount of P was decreased.

Fourth Example

Effects of the heating temperature on the characteristics of a valve guide were investigated. The iron powder, the iron-phosphorus alloy powder, the copper powder, and the graphite powder, which were used in the First Example, were prepared. Then, the iron-phosphorus alloy powder, the copper powder, and the graphite powder, which were in the amounts shown in Table 7, were added to the iron powder, and they were mixed to form a raw powder. The raw powder was compacted in the same conditions as in the First Example so as to obtain a green compact. The green compact was sintered at the heating temperature shown in Table 7 for 30 minutes and was cooled, whereby samples of samples Nos. 25 to 29 were formed. In the cooling from the heating temperature to room temperature, the cooling rate in the temperature range from 850 to 600° C. was 10° C./minute. The entire compositions of these samples are also shown in Table 7. In these samples, the wear test and the compressive strength test were performed under the same conditions as those in the First Example. Moreover, the area ratio of the iron-phosphorus-carbon compound phase and the area ratio of the copper phase were measured. These results are shown in Table 8. It should be noted that the values of the sample of the sample No. 04 in the First Example are also shown in Tables 7 and 8 as an example in which the heating temperature was 1000° C.

TABLE 7

| Sample No. | Mixing ratio mass % Iron powder | Iron-phosphorus alloy powder | Copper powder | Graphite powder | Heating temperature ° C. | Composition mass % Fe | P | Cu | C | Notes |
|---|---|---|---|---|---|---|---|---|---|---|
| 25 | Bal. | 0.80 | 2.00 | 2.00 | 920 | Bal. | 0.16 | 2.00 | 2.00 | Exceeds lower limit of heating temperature |
| 26 | Bal. | 0.80 | 2.00 | 2.00 | 970 | Bal. | 0.16 | 2.00 | 2.00 | Lower limit of heating temperature |
| 04 | Bal. | 0.80 | 2.00 | 2.00 | 1000 | Bal. | 0.16 | 2.00 | 2.00 | |
| 27 | Bal. | 0.80 | 2.00 | 2.00 | 1020 | Bal. | 0.16 | 2.00 | 2.00 | |
| 28 | Bal. | 0.80 | 2.00 | 2.00 | 1070 | Bal. | 0.16 | 2.00 | 2.00 | Upper limit of heating temperature |
| 29 | Bal. | 0.80 | 2.00 | 2.00 | 1100 | Bal. | 0.16 | 2.00 | 2.00 | Exceeds upper limit of heating temperature |

TABLE 8

| Sample No. | Area ratio of iron-phosphorus-carbon compound phase % | Area ratio of copper phase % | Compressive strength | Wear amount μm Valve guide | Valve stem | Total | Notes |
|---|---|---|---|---|---|---|---|
| 25 | 0.60 | 1.80 | 442 | 82 | 4 | 86 | Exceeds lower limit of heating temperature |
| 26 | 15.10 | 1.60 | 537 | 67 | 3 | 70 | Lower limit of heating temperature |
| 04 | 18.70 | 1.50 | 606 | 60 | 2 | 62 | |
| 27 | 19.00 | 1.30 | 630 | 59 | 2 | 61 | |
| 28 | 12.70 | 0.90 | 661 | 63 | 2 | 65 | Upper limit of heating temperature |
| 29 | 2.20 | 0.40 | 717 | 87 | 4 | 91 | Exceeds upper limit of heating temperature |

According to the samples of the samples Nos. 04 and 25 to 29 in Table 8, the effects of the heating temperature in the sintering are shown. According to the increase of the heating temperature in the sintering, the diffusion amount of Cu into the matrix was increased, whereby the amount of Cu remained as a copper phase was decreased. Therefore, the area ratio of the copper phase in the cross-sectional metallic structure was decreased with the increase of the heating temperature in the sintering. In the sample of the sample No. 29 in which the heating temperature was more than the melting point of Cu (1085° C.) and was 1100° C., most of the amount of Cu added in the form of the copper-tin alloy powder was diffused into the matrix. Therefore, the area ratio of the copper phase was only 0.4%.

In the sample of the sample No. 25 in which the heating temperature was 920° C., since the heating temperature was low in the sintering, C was not sufficiently diffused, and the plate-shaped iron-phosphorus-carbon compound phase was hardly precipitated. In contrast, in the samples of the samples Nos. 04 and 26 to 28 in which the heating temperature was 970 to 1070° C., C was sufficiently diffused. Therefore, sufficient amounts of the plate-shaped iron-phosphorus-carbon compound phases were obtained in the cross-sectional metallic structures. In this case, some of the area ratios of the iron-phosphorus-carbon compound phases were approximately equal to that of the conventional example (sample No. 10). On the other hand, when the heating temperature was more increased, the amount of Cu diffused in the matrix was increased, whereby the plate-shaped iron-phosphorus-carbon compound phase was difficult to be formed. Therefore, the precipitation amount of the plate-shaped iron-phosphorus-carbon compound phase was decreased, and the area ratio of the plate-shaped iron-phosphorus-carbon compound phase was decreased in the cross-sectional the metallic structure. In the sample of the sample No. 29 in which the heating temperature was more than the melting point of Cu (1085° C.) and was 1100° C., Cu was uniformly diffused into the matrix. As a result, the iron-phosphorus-carbon compounds were not precipitated as a large plate-shaped iron-phosphorus-carbon compound phase, but most of the iron-phosphorus-carbon compounds were precipitated in the shape of pearlite. Therefore, the area ratio of the plate-shaped iron-phosphorus-carbon compound phase was greatly decreased in the cross-sectional metallic structure.

According to the increase of the heating temperature in the sintering, since a greater amount of Cu for strengthening the matrix was diffused in the matrix, the compressive strength was increased. In the sample of the sample No. 25 in which the heating temperature was 920° C., Cu was not sufficiently diffused. Therefore, the compressive strength was less than 500 MPa and was not at a level that is required in a case of using the sintered compact as a valve guide. On the other hand, in the samples of the samples Nos. 04 and 26 to 29 in which the heating temperature was not less than 970° C., the diffusion amount of Cu into the matrix was increased. As a result, the compressive strengths were not less than 500 MPa and were at acceptable levels to use for valve guides.

In the sample of the sample No. 25 in which the heating temperature was 920° C., C was not sufficiently diffused, and the plate-shaped iron-phosphorus-carbon compound phase for improving the wear resistance was hardly precipitated. Therefore, the wear amount of the valve guide was great. On the other hand, in the sample of the sample No. 26 in which the heating temperature was 970° C., C was sufficiently diffused. Therefore, the precipitation amount of the plate-shaped iron-phosphorus-carbon compound phase was approximately the same as that of the conventional example (sample No. 10), and the wear amount of the valve guide was decreased. Moreover, in the samples of the samples Nos. 04, 27, and 28 in which the heating temperature was 1000 to 1070° C., the wear amount of the valve guide was even less due to the above effects. According to the increase of the heating temperature, the diffusion amount of Cu into the matrix was increased. Therefore, in the sample of the sample No. 29 in which the heating temperature was 1100° C., the area ratio of the precipitated plate-shaped iron-phosphorus-carbon compound phase was greatly decreased. Accordingly, the wear resistance was decreased, and the wear amount of the valve guide was further increased. The wear amount of the valve stem was approximately constant regardless of the heating temperature. Accordingly, the total wear amount was decreased when the heating temperature was in the range of 970 to 1070° C.

According to the above results, in the case of forming a sintered material for valve guides by using the iron-copper-carbon sintered alloy, when the heating temperature was 970 to 1070° C. in the sintering, the wear resistance was superior. In addition, when the heating temperature was in this range, the sintered compacts had strength at an acceptable level to use as a valve guide.

Fifth Example

Effects of the cooling rate on the characteristics of a valve guide were investigated. In the cooling of the sintered compact from the heating temperature to room temperature, the sintered compact was cooled from 850 to 600° C. at this cooling rate. The iron powder, the iron-phosphorus alloy powder, the copper powder, and the graphite powder, which were used in the First Example, were prepared. Then, the iron-phosphorus alloy powder, the copper powder, and the graphite powder, which were in the amounts shown in Table 9, were added to the iron powder, and they were mixed to form a raw powder. The raw powder was compacted in the same conditions as in the First Example so as to obtain a green compact. The green compact was sintered at 1000° C. for 30 minutes and was cooled, whereby samples of samples Nos. 30 to 34 were formed. In the cooling from the heating temperature to room temperature, the sintered compact was cooled from 850 to 600° C. at the cooling rate shown in Table 9. The entire compositions of these samples are also shown in Table 9. In these samples, the wear test and the compressive strength test were performed under the same conditions as those in the First Example. Moreover, the area ratio of the iron-phosphorus-carbon compound phase and the area ratio of the copper phase were measured. These results are shown in Table 10. It should be noted that the values of the sample of the sample No. 04 in the First Example are also shown in Tables 9 and 10 as an example in which the cooling rate in the above temperature range was 10° C./minute.

TABLE 9

| Sample No. | Mixing ratio mass % Iron powder | Iron-phosphorus alloy powder | Copper powder | Graphite powder | Heating temperature ° C. | Cooling rate ° C./minute | Composition mass % Fe | P | Cu | C | Notes |
|---|---|---|---|---|---|---|---|---|---|---|---|
| 30 | Bal. | 0.80 | 2.00 | 2.00 | 1000 | 5 | Bal. | 0.35 | 2.00 | 2.00 | |
| 04 | Bal. | 0.80 | 2.00 | 2.00 | 1000 | 10 | Bal. | 0.35 | 2.00 | 2.00 | |
| 31 | Bal. | 0.80 | 2.00 | 2.00 | 1000 | 15 | Bal. | 0.35 | 2.00 | 2.00 | |
| 32 | Bal. | 0.80 | 2.00 | 2.00 | 1000 | 20 | Bal. | 0.35 | 2.00 | 2.00 | |
| 33 | Bal. | 0.80 | 2.00 | 2.00 | 1000 | 25 | Bal. | 0.35 | 2.00 | 2.00 | Upper limit of cooling rate |
| 34 | Bal. | 0.80 | 2.00 | 2.00 | 1000 | 30 | Bal. | 0.35 | 2.00 | 2.00 | Exceeds upper limit of cooling rate |

TABLE 10

| Sample No. | Area ratio of iron-phosphorus-carbon compound phase % | Area ratio of copper phase % | Compressive strength | Wear amount μm Valve guide | Valve stem | Total | Notes |
|---|---|---|---|---|---|---|---|
| 30 | 22.00 | 1.55 | 538 | 61 | 4 | 65 | |
| 04 | 18.70 | 1.50 | 606 | 60 | 2 | 62 | |
| 31 | 17.10 | 1.45 | 624 | 62 | 1 | 63 | |
| 32 | 13.10 | 1.50 | 653 | 68 | 2 | 70 | |
| 33 | 5.70 | 1.50 | 709 | 71 | 3 | 74 | Upper limit of cooling rate |
| 34 | 2.50 | 1.55 | 735 | 88 | 7 | 95 | Exceeds upper limit of cooling rate |

When the cooling rate in the temperature range from 850 to 600° C. was lower, the area ratio of the iron-phosphorus-carbon compound phase was increased in the cross-sectional metallic structure. In other words, when the cooling rate was greater, the area ratio of the iron-phosphorus-carbon compound phase was decreased. That is, C at amount in which C was supersaturated at room temperature, was solved in the austenite in the heating temperature range in the sintering, and supersaturated C in this heating temperature range was precipitated as iron carbides ($Fe_3C$). If the sintered compact in this temperature range is cooled at a low cooling rate, the precipitated iron carbides grow, whereby the amount of the iron-phosphorus-carbon compound phase is increased. On the other hand, if the sintered compact in this temperature range is cooled at a high cooling rate, the precipitated iron carbides do not grow sufficiently. Therefore, the ratio of the pearlite, in which fine iron carbides are dispersed, is increased, and the amount of the iron-phosphorus-carbon compounds is decreased. When the cooling rate was increased to 25° C./minute during the cooling from 850 to 600° C., the area ratio of the iron-phosphorus-carbon compound phase came to 5.7% in the cross-sectional metallic structure. Moreover, when the cooling rate was more than 25° C./minute, the area ratio of the iron-phosphorus-carbon compound phase was less than 3%.

On the other hand, the copper phase was not formed of supersaturated Cu that was precipitated and was diffused, but was formed of copper powder that was not dispersed and remained as a copper phase. Therefore, the area ratio of the copper phase in the cross-sectional metallic structure was constant regardless of the cooling rate.

When the cooling rate was greater during the cooling from 850 to 600° C., the amount of the fine iron carbides were increased, and the amount of the plate-shaped iron-phosphorus-carbon compound phase was decreased. Therefore, the compressive strength was increased with the increase of the cooling rate. When the cooling rate was greater during the cooling from 850 to 600° C., since the amount of the iron-phosphorus-carbon compound phase for improving the wear resistance was decreased, the wear amount of the valve guide was slightly increased. Moreover, when the cooling rate was increased to more than 25° C./minute during the cooling from 850 to 600° C., the area ratio of the iron-phosphorus-carbon compound phase was less than 3%, and the wear amount of the valve guide was suddenly increased.

According to the above results, by controlling the cooling rate during the cooling from 850 to 600° C., the amount of the plate-shaped iron-phosphorus-carbon compound phase was controlled. In this case, by setting the cooling rate to be not more than 25° C./minute during the cooling from 850 to 600° C., the area ratio of the plate-shaped iron-phosphorus-carbon compound phase was made to be not less than 3% in the cross-sectional metallic structure, and superior wear resistance was obtained. It should be noted that if the cooling rate is too low during the cooling from 850 to 600° C., the time required for cooling from the heating temperature to room temperature becomes long, and the production cost is increased. Accordingly, the cooling rate is preferably set to be not less than 5° C./minute during the cooling from 850 to 600° C.

Sixth Example

Effects of isothermal holding time on the characteristics of a valve guide were investigated. The sintered compact was isothermally held at a predetermined time at a temperature in the range of 850 to 600° C. in the cooling from the heating temperature to room temperature. The iron powder, the iron-phosphorus alloy powder, the copper powder, and the graphite powder, which were used in the First Example, were prepared. Then, the iron-phosphorus alloy powder, the copper powder, and the graphite powder, which were in the amounts shown in Table 11, were added to the iron powder, and they were mixed to form a raw powder. The raw powder was compacted in the same conditions as in the First Example so as to obtain a green compact. The green compact was sintered at 1000° C. for 30 minutes and was cooled from the heating temperature to room temperature, whereby samples of samples Nos. 35 to 38 were formed. The sintered compact was cooled at a cooling rate of 30° C./minute during the cooling from 850 to 780° C. Then, the sintered compact was isothermally held at 780° C. for a holding time shown in Table 11 and was cooled from 780 to 600° C. at a cooling rate of 30° C./minute. In these samples, the wear test and the compressive strength test were performed under the same conditions as those in the First Example. Moreover, the area ratio of the plate-shaped iron-phosphorus-carbon compound phase and the area ratio of the copper phase were measured. These results are shown in Table 12. It should be noted that the values of the sample of the sample No. 34 in the Fifth Example are also shown in Tables 11 and 12 as an example. The sample of the sample No. 34 was cooled from 850 to 600° C. at a cooling rate of 30° C./minute and was not isothermally held.

TABLE 11

| | Mixing ratio mass % | | | | | Isothermal | | | | | | |
|---|---|---|---|---|---|---|---|---|---|---|---|---|
| Sample No. | Iron powder | Iron-phosphorus alloy powder | Copper powder | Graphite powder | Heating temperature ° C. | Cooling rate ° C./minute | holding time minutes | Composition mass % Fe | P | Cu | C | Notes |
| 34 | Bal. | 0.80 | 2.00 | 2.00 | 1000 | 30 | 0 | Bal. | 0.35 | 2.00 | 2.00 | Exceeds lower limit of isothermal holding time |
| 35 | Bal. | 0.80 | 2.00 | 2.00 | 1000 | 30 | 10 | Bal. | 0.35 | 2.00 | 2.00 | Lower limit of isothermal holding time |
| 36 | Bal. | 0.80 | 2.00 | 2.00 | 1000 | 30 | 30 | Bal. | 0.35 | 2.00 | 2.00 | |
| 37 | Bal. | 0.80 | 2.00 | 2.00 | 1000 | 30 | 60 | Bal. | 0.35 | 2.00 | 2.00 | |
| 38 | Bal. | 0.80 | 2.00 | 2.00 | 1000 | 30 | 90 | Bal. | 0.35 | 2.00 | 2.00 | |

TABLE 12

| | | | | Wear amount μm | | | |
|---|---|---|---|---|---|---|---|
| Sample No. | Area ratio of iron-phosphorus-carbon compound phase % | Area ratio of copper phase % | Compressive strength | Valve guide | Valve stem | Total | Notes |
| 34 | 2.50 | 1.55 | 735 | 88 | 7 | 95 | Exceeds lower limit of isothermal holding time |
| 35 | 7.00 | 1.50 | 677 | 70 | 3 | 73 | Lower limit of isothermal holding time |
| 36 | 18.80 | 1.50 | 632 | 61 | 2 | 63 | |
| 37 | 22.50 | 1.40 | 536 | 62 | 2 | 64 | |
| 38 | 23.40 | 1.45 | 518 | 65 | 4 | 69 | |

The samples of the samples Nos. 35 to 38 were cooled at the cooling rate at which the area ratio of the plate-shaped iron-phosphorus-carbon compound phase was less than 3% in the cross-sectional metallic structure in the Fifth Example. In this case, these samples were isothermally held at the temperature in the range of 850 to 600° C. during the cooling from the heating temperature to room temperature. Therefore, the area ratios of the plate-shaped iron-phosphorus-carbon compound phases were increased to not less than 3%. According to the increase of the isothermal holding time, the area ratio of the plate-shaped iron-phosphorus-carbon compound phase was increased. That is, by isothermal holding at the temperature range in which supersaturated C in the austenite was precipitated as iron carbides, the precipitated iron carbides sufficiently grew. As a result, the area ratio of the plate-shaped iron-phosphorus-carbon compound phase was increased. Therefore, according to the increase of the isothermal holding time in this temperature range, the area ratio of the plate-shaped iron-phosphorus-carbon compound phase can be increased. Accordingly, when the sintered compact is isothermally held in this temperature range, since the plate-shaped iron-phosphorus-carbon compound phase grows during the isothermal holding, the cooling rate before and after the isothermal holding can be increased.

On the other hand, the copper phase was not formed of supersaturated Cu that was precipitated and was diffused, but was formed of copper powder that was not dispersed and remained as a copper phase. Therefore, the area ratio of the copper phase in the cross-sectional metallic structure was constant regardless of the isothermal holding time.

When the isothermal holding time in the temperature range of 850 to 600° C. was shorter, the time required for growing the plate-shaped iron-phosphorus-carbon compounds was shorter, and the area ratio of the plate-shaped iron-phosphorus-carbon compound phase was decreased. In other words, when the isothermal holding time was longer, the time required for growing the iron carbides were longer, and the area ratio of the plate-shaped iron-phosphorus-carbon compound phase was increased. Therefore, the compressive strength was decreased with the increase of the isothermal holding time. When the isothermal holding time in the temperature range of 850 to 600° C. was longer, the amount of the plate-shaped iron-phosphorus-carbon compound phase for improving the wear resistance was increased. Therefore, the wear amount of the valve guide was decreased with the increase of the isothermal holding time.

According to the above results, by isothermal holding at a temperature in the range of 850 to 600° C., the amount of the plate-shaped iron-phosphorus-carbon compound phase was controlled. By isothermal holding for not less than 10 minutes, the area ratio of the plate-shaped iron-phosphorus-carbon compound phase was made to be not less than 5% in the cross-sectional metallic structure, and superior wear resistance was obtained. In this case, if the isothermal holding time is too long, the time required for cooling from the heating temperature to room temperature becomes long, and the production cost is increased. Therefore, the isothermal holding time is preferably set to be not more than 90 minutes.

What is claimed is:

1. A sintered material for valve guides, consisting of, by mass %, 0.01 to 0.3% of P, 1.3 to 3% of C, 1 to 4% of Cu, and the balance of Fe and inevitable impurities, the sintered material exhibiting a metallic structure made of pores and a matrix, the matrix being a mixed structure of a pearlite phase, a ferrite phase, an iron-phosphorus-carbon compound phase, and a copper phase, and a part of the pores including graphite that is dispersed therein, wherein the iron-phosphorus-carbon compound phase is dispersed at 3.1% to 25% by area ratio, and the copper phase is dispersed at 0.5 to 3.5% by area ratio, with respect to a cross section of the metallic structure, respectively.

2. The sintered material for valve guides according to claim 1, wherein the iron-phosphorus-carbon compound phase is a plate-shaped iron-phosphorus-carbon compound having an area of not less than 0.05% in a visual field in a cross-sectional structure at 200-power magnification, and a total area of the plate-shaped iron-phosphorus-carbon compounds having an area of not less than 0.15% in the visual field is 3 to 50% with respect to a total area of the plate-shaped iron-phosphorus-carbon compounds.

3. The sintered material for valve guides according to claim 1, wherein at least one kind selected from the group consisting of manganese sulfide particles, magnesium silicate mineral particles, and calcium fluoride particles are dispersed in particle boundaries of the matrix and in the pores at not more than 2 mass %.

4. A production method for a sintered material for valve guides, comprising:

preparing an iron powder, an iron-phosphorus alloy powder, a copper powder, and a graphite powder;

mixing the iron-phosphorus alloy powder, the copper powder, and the graphite powder with the iron powder into a raw powder consisting of, by mass %, 0.01 to 0.3% of P, 1.3 to 3% of C, 1 to 4% of Cu, and the balance of Fe and inevitable impurities;

filling a tube-shaped cavity of a die assembly with the raw powder;

compacting the raw powder into a green compact having a tube shape; and sintering the green compact at a heating temperature of 970 to 1070° C. in a nonoxidizing atmosphere so as to obtain a sintered compact.

5. The production method for the sintered material for valve guides according to claim 4, wherein the amount of P is 0.01 to less than 0.1 mass % in the entire composition of the raw powder.

6. The production method for the sintered material for valve guides according to claim 4, wherein the green compact is held at the heating temperature for 10 to 90 minutes in the sintering.

7. The production method for the sintered material for valve guides according to claim 4, wherein the sintered compact is cooled from the heating temperature to room temperature after the sintering, and the sintered compact is cooled from 850 to 600° C. at a cooling rate of 5 to 25° C. per minute.

8. The production method for the sintered material for valve guides according to claim 4, wherein the sintered compact is cooled from the heating temperature to room temperature, and the sintered compact is isothermally held at a temperature in the range of 850 to 600° C. for 10 to 90 minutes and is then cooled.

9. The production method for the sintered material for valve guides according to claim 4, wherein at least one kind selected from the group consisting of a manganese sulfide powder, a magnesium silicate mineral powder, and a calcium fluoride powder is added to the raw powder at not more than 2 mass % in the mixing.

10. The sintered material for valve guides according to claim 1, wherein the iron-phosphorous-carbon compound phase is dispersed at 10.3% by area ratio.

11. The production method for a sintered material for valve guides according to claim 4, wherein the iron-phosphorous alloy powder consists of 15.6 to 21.7 mass % of P, and the balance of Fe and inevitable impurities.

* * * * *